US005115618A

United States Patent [19]

Janhonen

[11] Patent Number: 5,115,618

[45] Date of Patent: May 26, 1992

[54] METHOD FOR PACKAGING BOOKS

[75] Inventor: Veikko I. Janhonen, Helsinki, Finland

[73] Assignee: Pussikeskus Oy, Helsinki, Finland

[21] Appl. No.: 506,422

[22] Filed: Apr. 9, 1990

[30] Foreign Application Priority Data

Apr. 19, 1989 [FI] Finland ..... 891858

[51] Int. Cl.[5] ..... B65B 11/50

[52] U.S. Cl. ..... 53/449; 53/441; 53/461

[58] Field of Search ..... 53/176, 399, 441, 442, 53/449, 461, 462, 463, 170, 219, 207, 209, 427; 206/424; 229/40

[56] References Cited

U.S. PATENT DOCUMENTS

| | | | |
|---|---|---|---|
| 1,830,342 | 11/1931 | Stokes | 53/462 X |
| 1,885,345 | 11/1932 | Guthrie | 53/441 X |
| 2,980,245 | 4/1961 | Stoker | 53/441 X |
| 3,587,839 | 6/1971 | Von Brecht | 53/442 X |
| 3,654,744 | 4/1972 | Smith | 53/427 X |
| 3,666,166 | 5/1972 | Freakes | 206/424 X |
| 4,300,679 | 11/1981 | Benzschawel et al. | 206/424 |
| 4,328,896 | 5/1982 | Behne | 53/441 X |
| 4,575,991 | 3/1986 | Hollingsworth | 53/421 X |
| 4,589,552 | 5/1986 | Chevalier | 206/424 X |
| 4,627,223 | 12/1986 | Janhonen | 53/449 |
| 4,677,809 | 7/1987 | Long et al. | 53/427 |
| 4,757,666 | 7/1988 | Janhonen | 53/218 X |

FOREIGN PATENT DOCUMENTS

| | | | |
|---|---|---|---|
| 0342477 | 11/1989 | European Pat. Off. | 53/449 |

*Primary Examiner*—Robert L. Spruill
*Assistant Examiner*—Daniel B. Moon
*Attorney, Agent, or Firm*—Price, Heneveld, Cooper, DeWitt & Litton

[57] ABSTRACT

The invention relates to a method for packaging books. The book(s) to be packaged are placed upon a rectangular flat cardboard sheet (11), followed by pulling over the book/books a separate plastic film or paper (17), which is transverse relative to the cardboard sheet and whose ends are fastened to the cardboard sheet to its top surfaces (14) adjacent the long edges thereof, and the ends of said cardboard sheet are folded around an article to be packaged for producing a tubular protective wrapping.

16 Claims, 3 Drawing Sheets

METHOD FOR PACKAGING BOOKS

The present invention relates to a method for packaging or wrapping books or the like articles by using a packaging blank, comprising a rectangularly-shaped sheet of cardboard and a protective wrapper made of plastic film or paper.

U.S. Pat. No. 4,627,223 discloses a packaging method, the protective wrapper for a packaging blank used therein being previously fastened to the surface of a sheet of cardboard. This prior known packaging method requires that the protective wrapper be first wrapped around the books to be packaged. The sheet of cardboard made of a rather rigid material can be folded mechanically. An apparatus has been developed for this purpose and one embodiment thereof has been described in U.S. Pat. No. 4,757,666 and another embodiment in U.S. Pat. No. 4,972,653.

An object of the invention is to further develop this packaging method for books in a manner such that the protective wrapper need not be manually wrapped around the books and also that the material costs of a protective wrapper can be minimized.

The invention will now be described in more detail with reference made to the accompanying drawings, in which.

Figure 6:
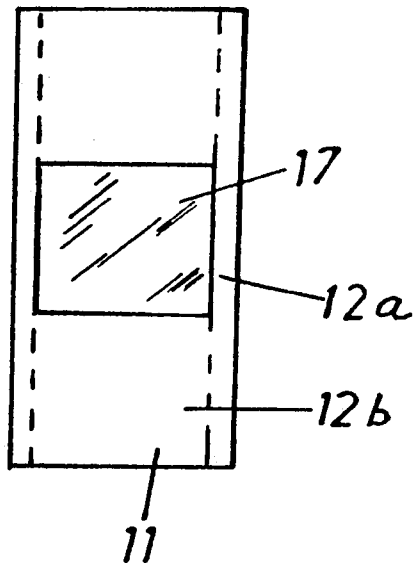
FIG. 6 is a view similar to FIG. 3, except it is prior to folding of the marginal reinforcements.
Figure 1:
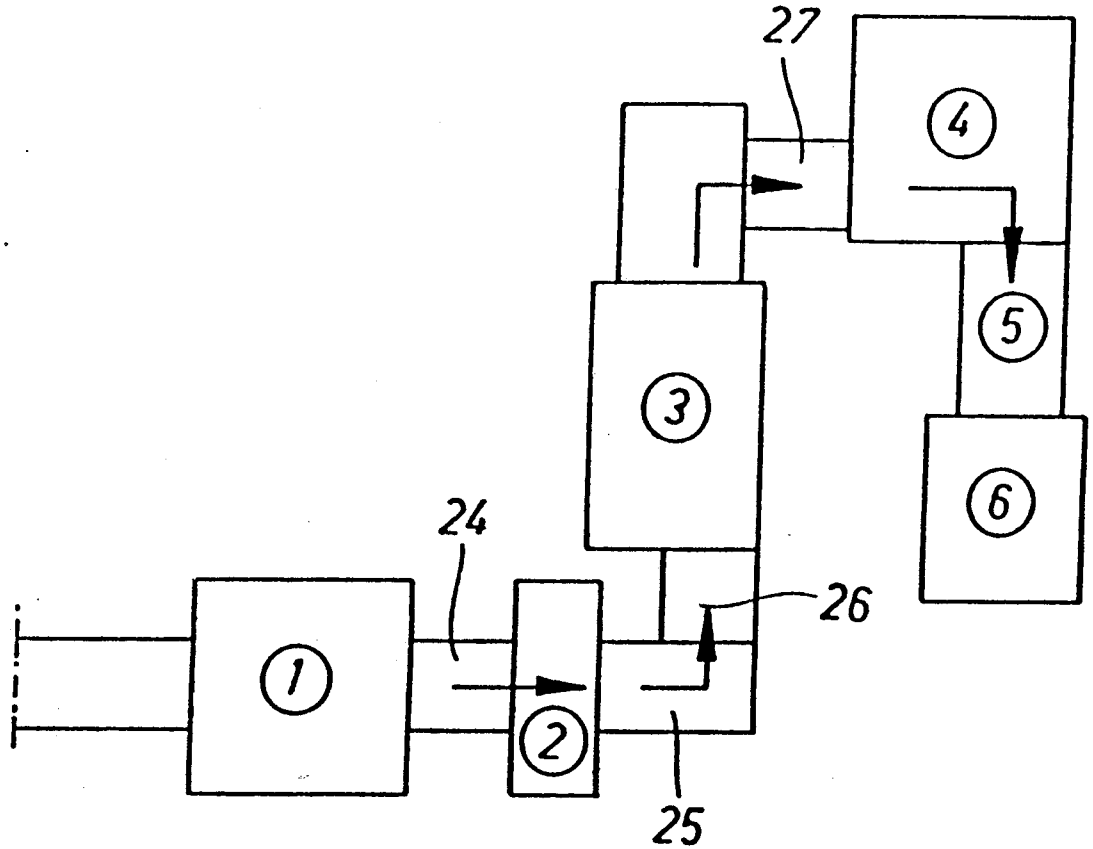
FIG. 1 is a schematic plan view of an apparatus used for carrying out the method. Reference numerals 1–6 indicate working stations for various steps of the method.
Figures 2, 3, 4:
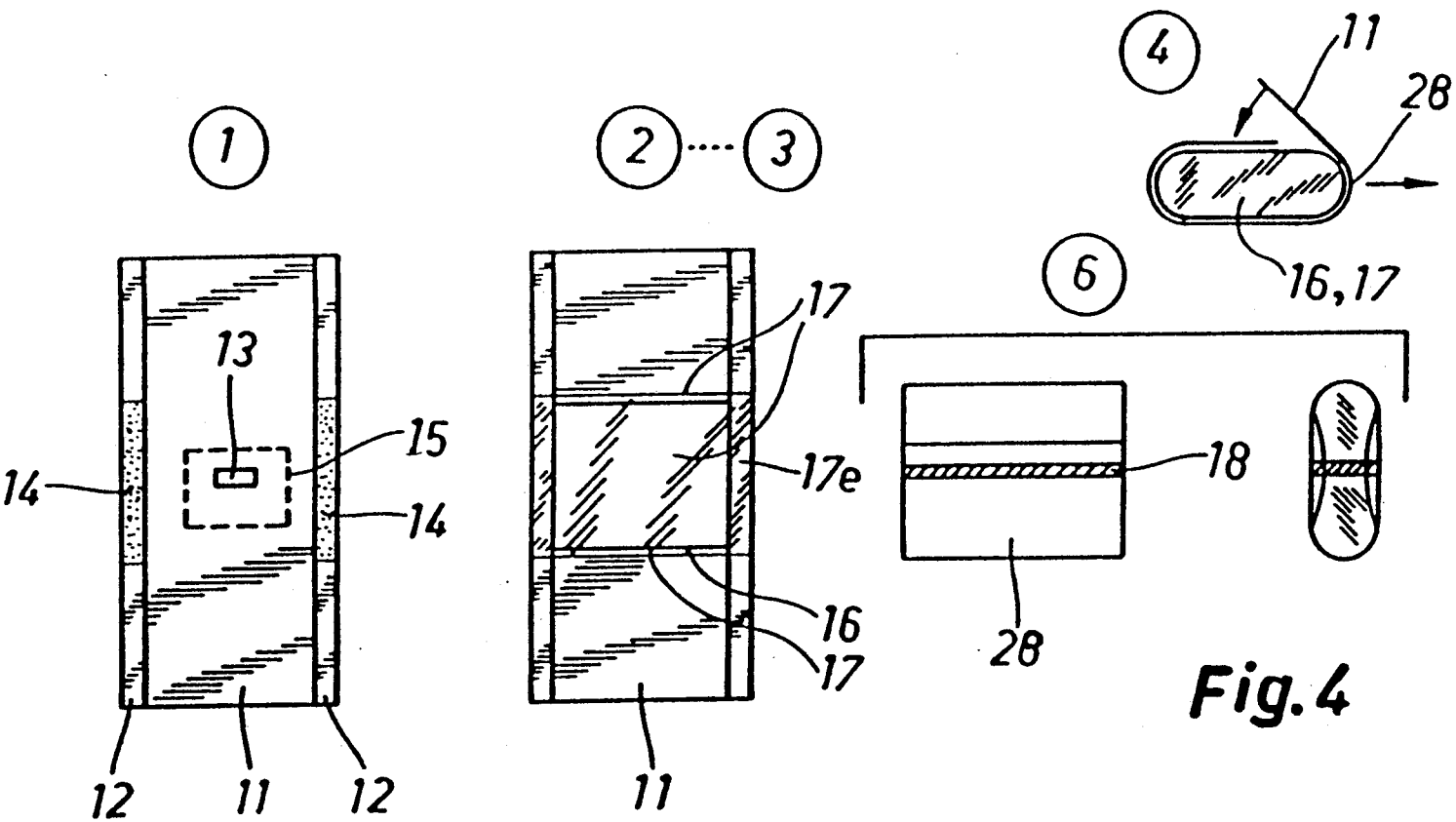
FIG. 2 shows a rectangular sheet of cardboard which makes up a prefabricated packaging blank.
FIG. 3 shows a packaging blank at the time a protective wrapper 17 has been pulled over an article 16.
FIG. 4 illustrates a packaging blank at a fabrication stage (4) and in finished form (6).

A packaging blank shown in FIG. 2 comprises a rectangular, flat sheet of cardboard 11 whose edges are double-folded for providing marginal reinforcements 12. To do this, the outer edge strip 12*a* is folded over onto the inner edge strip 12*b*, and alternatively, also over the edge of the protective wrapper 17. Sheet 11 is provided with an aperture 13 for placing thereon a shipping and invoice form 15 in a manner that the address is visible through aperture 13. The sheet of cardboard 11 is laid on a table 1 (FIG. 1) for placing book(s) 16 upon said sheet of cardboard 11 between prefabricated marginal zones 14. The top surfaces of the longitudinal edges of such sheet of cardboard are pretreated by coating areas 14 with an adhesive or a plastic film which can be made adhesive by heat activation. In the present case, aperture 13 and pretreated areas 14 are in alignment with each other in the central region of a sheet but can also be provided adjacent the opposite ends of a sheet whereby, in a finished package, such areas will be on the opposite flat sides of a package and the overlapping of the ends of cardboard sheet 11 will be adjacent to the narrow side of a package.

It is also possible that a cardboard sheet to be laid on table 1 has not yet been provided with marginal folds 12, whereby the pretreated surfaces 14 remain between marginal folds 12 to be formed later.

Figure 5:
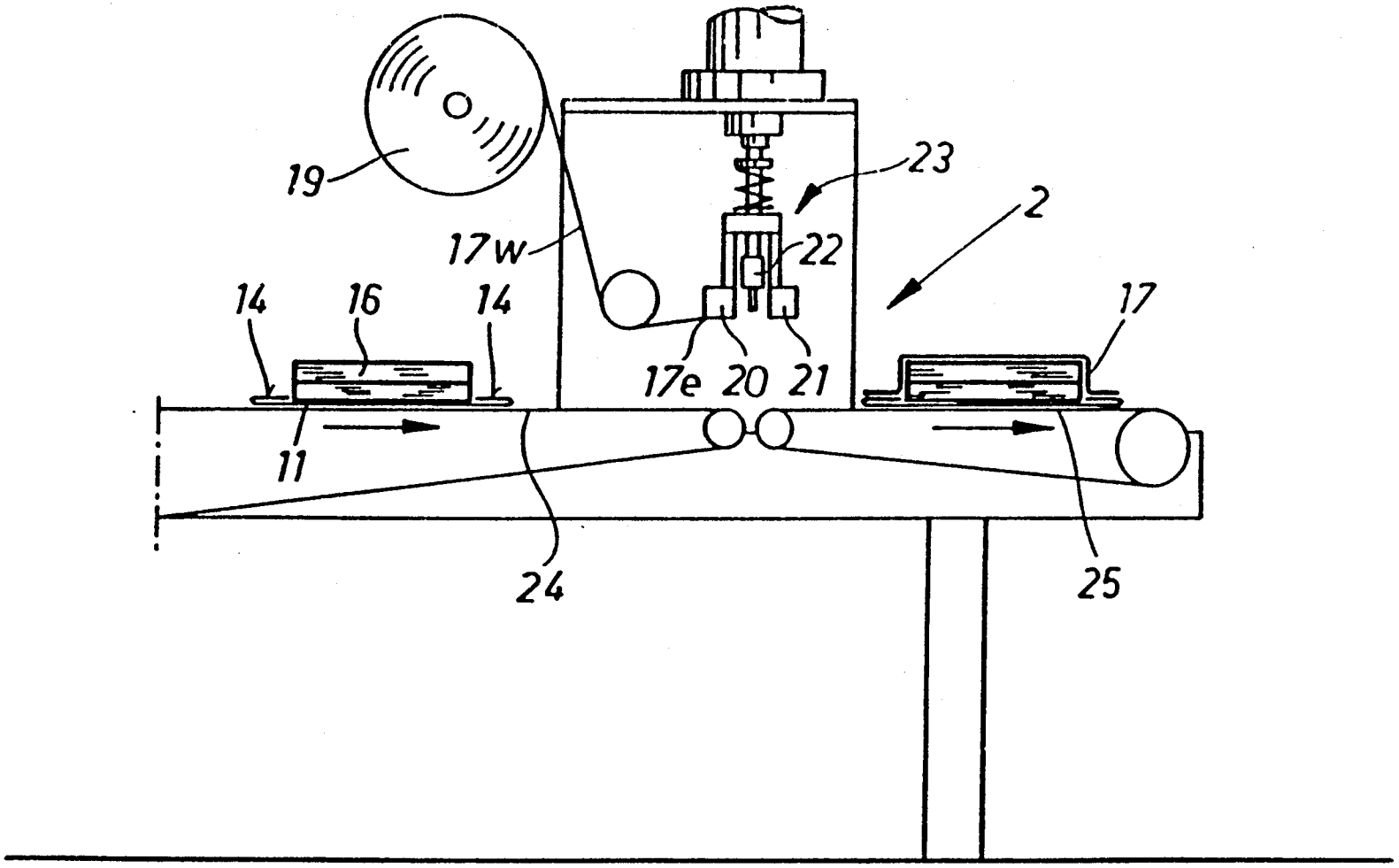
FIG. 5 shows in more detail an apparatus used for carrying out the essential working step of the invention, the apparatus being at station 2 of FIG. 1.

From table 1 said packaging blank along with books 16 is carried—in the advancing direction transverse to the longitudinal direction of sheet 11 by means of a conveyor 24 to a station 2 for pulling a protective wrapper 17 over books 16 and for fastening said wrapper to pretreated marginal zones 14. This is effected by means of an apparatus shown in FIG. 5 as follows. The leading end 17*e* of a plastic film or paper web 17*w* unwound from a reel 19 is fastened by the application of vacuum suction to a jaw 20 which is first in the packaging blank advancing direction. That is followed by a jaw 21 further down in the conveying direction. Jaws 20 and 21 are provided with a heating device and mechanically coupled together to be moved up and down together. Between the jaws is a cutting means 22 which is movable up and down relative to the jaws.

As the leading pretreated marginal surface 14 of a packaging blank arrives under jaw 20, said jaw 20 effects a working stroke and fastens the end 17*e* of plastic film web 17*w* to marginal surface 14 by heat sealing. If web 17*w* is made of paper, said surfaces 14 are sprayed with a hot-setting adhesive before the packaging blank arrives in fastening and cutting unit 23. Thus, jaws 20 and 21 need not be heated.

The next step is to lift up said unit 23 and the packaging blank is advanced by means of conveyors 24 and 25 until the trailing pretreated marginal surface 14 arrives under jaw 21. Another working stroke is effected, so that jaw 21 fastens web 17*w* to surface 14. The suction device of jaw 21 is used to grip the web and cutting means 22 is operated to severe the web whose leading end 17*e* remains attached to jaw 20 waiting for another packaging blank.

As a packaging blank is carried below jaw unit 23 and as a working stroke is effected by means of jaw 21, said film or paper 17 is tightened to a suitable tension. If the wrapping is of a so-called contraction plastic film, it will be pulled to an elongated tension prior to its attachment to trailing surface 14. If the wrapping is of a shrink-plastic film, the final tightening is effected in a heating unit 3, the packaging blank being carried therethrough by means of a conveyor 26 in the longitudinal direction of sheet 11.

Following said heating unit 3, the advancing direction is again deflected by means of a conveyor 27 for carrying the packaging blank in the transverse direction of sheet 11. A station 4 is provided with a folding machine for cardboard sheet 11. It can be of the type disclosed in U.S. Pat. No. 4,757,666 but in the scheme of FIG. 1, as the advancing direction again shifts from folding machine 4 to a conveyor 5, there is required a folding machine disclosed in U.S. Pat. No. 4,972,653 which folds one end of cardboard sheet 11 while pushing the package out of the machine with lateral edge 28 leading.

A station 6 is provided with a binding machine for winding a band 18 around a package in the longitudinal direction of a package in a manner that the reinforced marginal zones 12 extending beyond the ends of books 16 are folded towards each other for preventing the movement of books inside the package even in case the wrapper 17 should not be tightly tensioned over said books 16 (which is nevertheless recommended).

The use of a band 18 is not absolutely necessary (although recommended) in the case of a strong contraction or shrink-plastic film 17 whose ends are secured between marginal folds 12 and sheet 11, in which case there is practically no danger of the ends of film 17 ripping off. This requires a unit for making marginal folds 12 between units 2 and 3 along with its adhesive-applying station and folding means.

I claim:

1. The method of packaging a flat article of rectangular shape including the steps of providing a flat rectangular cardboard sheet (11) having greater length than width and a protective wrapper (17) of flexible material, while the cardboard sheet is flat placing the article (16) on said cardboard sheet centered about the geometric center of said cardboard, bonding an end of the flexible material to the upwardly facing surface of one unfolded lengthwise edge portion of said cardboard sheet and wrapping the flexible material over the article and bonding it to the upwardly facing surface of the other of the unfolded lengthwise edge portions of said cardboard sheet and folding both of said lengthwise edge portions of the cardboard sheet over the upwardly facing surface of the sheet to form marginal reinforcements (12) and clamp the ends of the protective wrapper (17) in said folded marginal reinforcements, folding said cardboard sheet about the article in a direction at a right angle to that along which the flexible material was wrapped about the article.

2. The method for packaging articles of the shape as described in the claim 1 wherein said flexible material is drawn taut over the articles before bonding it to the other of the upwardly facing edge portions of this cardboard sheet.

3. The method for packaging a flat article of rectangular configuration as described in claim 1 wherein the flexible sheet is caused to be drawn taut over the article by application of heat thereto.

4. The method for packaging flat articles of rectangular shape as described in claim 1 wherein said flexible sheet is held closely adjacent and substantially parallel to the surface of the article while the flexible sheet is being bonded to the upwardly facing surface of the other of the lengthwise edge portions of the cardboard sheet.

5. The method of packaging a flat article as described in claim 1 wherein said flexible material is provided as a continuous length of flexible material and passed over the article after the flexible material is secured to the cardboard sheet on one side of the article, securing the flexible material to the other side of the cardboard sheet, after securing the flexible material to both sides of the cardboard sheet severing the flexible material wrapped about the article from the remainder of the flexible material.

6. The method of packaging a flat article as described in claim 1 wherein said flexible material is a film of a heat shrinkable material, after both ends of said flexible material have been bonded to said cardboard sheet heating said flexible material to shrink it to fit tightly about the article.

7. The method of packaging a flat article as described in claim 1 wherein said flexible material is a film of stretchable material, applying tension to said material to draw it firmly around the article and then securing the flexible material to the upwardly facing surface of the other lengthwise edge portion of said cardboard sheet, after it has been tensioned and secured severing the flexible material so secured from the remainder of said flexible material.

8. The method set forth in claim 1 further characterized in that the ends of the protective wrapper (17) remain between the marginal reinforcements (12) and the cardboard sheet (11) and the flexible material is drawn taut over the article before bonding to said other parallel edge of the cardboard sheet.

9. The method for packaging an article of flat rectangular shape including the steps of providing a flat elongated rectangular sheet of cardboard having greater length than width, placing the article on said sheet centered between the sides of said sheet having the greater length, providing a length of flexible protective wrapping material of a width greater than that of the article in the direction of the length of the cardboard sheet and bonding it to said sheet adjacent one of the sides of greater length of said sheet and centered about the article seated on said sheet, causing said wrapping material to be pulled over said article and bonded to said sheet adjacent the side thereof opposite from the side to which the wrapping material was first bonded and causing said wrapping material to fit tightly against said article, the sides of said sheet to which the wrapping material has been bonded being folded over upon said sheet and then wrapping said sheet around the article in a direction at a right angle to the direction in which said wrapping material extends over the article to form a tubular outer protective shipping package for the article.

10. The method of packaging an article as described in claim 9 including the steps of placing the article centered about the geometric center of said sheet.

11. The method of packaging an article as described in claim 9 wherein said wrapping material is caused to fit tightly about the article by tension applied to the wrapping material prior to being bonded to the other of the sides of said sheet.

12. The method of packaging an article as described in claim 9 wherein said wrapping material is caused to fit tightly about the article by the application of heat after the wrapping material has been bonded to both edges of said sheet.

13. The method of packaging an article as described in claim 9 wherein said wrapping material is provided as a continuous length which is secured to said cardboard sheet, the wrapping material which extends over the article being severed from the remainder thereof after that which extends over the article has been bonded to the cardboard sheet on both sides of the article.

14. The method of packaging an article as described in claim 9 wherein the article is a book of flat rectangular configuration.

15. The method of packaging a book of flat rectangular configuration described in claim 9 wherein each of said longitudinal edge portions of said cardboard sheet are folded over upon said cardboard sheet and the longitudinal edges of said flexible material are seated between said folded edge portions and bonded thereto.

16. The method for packaging an article of flat rectangular shape including the steps of providing a flat elongated rectangular sheet of cardboard having greater length than width, placing the article on said sheet centered between the sides of said sheet having the greater length, providing a length of flexible protective wrapping material of a width greater than that of the article in the direction of the length of the cardboard sheet and bonding it to said sheet adjacent one of the sides of greater length of said sheet and centered about the article seated on said sheet, causing said wrapping material to be pulled over said article and bonded to said sheet adjacent the side thereof opposite from the side to which the wrapping material was first bonded and causing said wrapping material to fit tightly against said article, the sides of said sheet being folded over upon said sheet and then wrapping said sheet around the article in a direction at a right angle to the direction in which said wrapping material extends over the article to form a tubular outer protective shipping package for the article.

* * * * *